United States Patent [19]

Lee

[11] Patent Number: 4,677,883

[45] Date of Patent: Jul. 7, 1987

[54] CORK SCREW

[76] Inventor: Wen-Hsin Lee, 4th Fl., No. 61, Lui-Ho I Road, Kaohsiung City, Taiwan

[21] Appl. No.: 872,121

[22] Filed: Jun. 9, 1986

[51] Int. Cl.[4] ..... B67B 7/04

[52] U.S. Cl. ..... 81/3.37; 81/3.29; 81/3.45

[58] Field of Search ..... 81/3.29, 3.33, 3.36, 81/3.37, 3.45, 3.07, 3.08, 3.48, 3.31, 3.32; D8/40, 42

[56] References Cited

U.S. PATENT DOCUMENTS 344,566 6/1886 Cluever ..... 81/3.29

420,572 2/1890 Edie ..... 81/3.33

OTHER PUBLICATIONS

Tire-Bouchon, Par M. Perille, PL II, FIG. 7, Apr. 15, 1876, 81/3.37.

*Primary Examiner*—Frederick R. Schmidt

*Assistant Examiner*—Debra S. Meislin

[57] ABSTRACT

A cork screw which has a screw stem with a rotary handle incorporating a penetrating screw, and a hollow pedestal to be seated on a bottle sleeved movably on the stem and encasing the penetrating screw. Dog members are fulcrumed on the pedestal and engage releaseably with a helical groove of the screw stem. Upon rotation of the handle, the penetrating screw penetrates into the cork and subsequently pulls out the cork from the bottle.

3 Claims, 5 Drawing Figures

CORK SCREW

BACKGROUND OF THE INVENTION

This invention relates to a cork screw, and particularly to a cork screw which has a screw stem with a rotary handle incorporating a penetrating screw, and a hollow pedestal, to be seated on a bottle, sleeved movably on the stem and encasing the penetrating screw, the screw stem being capable of pulling out the penetrating screw together with a cork of the bottle upon rotation relative to the pedestal.

Various forms of cork screws have been existed in the art. FIG. 1 shows an earliest cork screw which has been found to be inconvenient and dangerous because it can not be controlled when manipulated, and when pulling the cork from the bottle, an excessive pulling force may cause the bottle to go out of control or even cause injury to the user. FIG. 2 shows a latter conventional cork screw wherein a handle body 81 incorporates a hollow member 82 having a helical groove on its periphery. When the body 81 is rotated to cause a penetrating screw 83 to penetrate into a cork of a bottle until the hollow member 82 seats against the spout of the bottle, the handle body 81 moves axially as it rotates, pulling the cork away from the bottle. Although this cork screw has improvements over the former cork screw, some similar disadvantages still exist therein, in that the manipulation of the latter cork screw requires substantial force, and the exposed penetrating screw may harm the children.

FIG. 3 shows an another cork screw in which a stem 91 with rack teeth 911 incorporates a penetrating screw 912 which is encased in a hollow pedestal 90. Two pinions 921 are engaged with the rack teeth 911 and mounted on the pedestal cooperatively with two lever. In operation, the pedestal is seated on the spout of a bottle, and when the penetrating screw is inserted into a cork by rotating the stem, the levers 92 will turn upward. The cork is pulled out from the bottle by pressing down the levers. This device alleviates the disadvantages of the above-described cork screws. However, it is still unsatisfactory since substantial force is required to press down the levers, and in addition, it is inconvenient for one to press the levers at the points which are efficient in regard of the arms of force because the levers are stretched to such an extent that one can not depress with only one hand.

An improved cork screw which is safer and more convenient than the above-described cork screw is proposed by the inventor of the application in U.S. Pat. No. 4,572,034, wherein a penetrating screw is encased in a pedestal and a cork pulling lever is incorporated into a rotary handle so as to pull out the cork by pulling the lever upward.

SUMMARY OF THE INVENTION

An object of the invention is to provide an improved cork screw which is safer, and more convenient than all of those described-above and which has a simplified construction relative to the last of the above-described cork screws.

According to the present invention, a cork screw comprises: a rotary handle; a stem connected to the handle and having a helical groove extending on the periphery of the stem; a penetrating screw connected to the stem; a hollow pedestal sleeved movably on the stem and encasing the penetrating screw, the pedestal having a bottom open and adapted to be seated against a spout of a bottle; two dog members fulcrumed at two opposite outer sides of the pedestal and each having a first engaging end extending into said pedestal through the wall of the pedestal; springs members attached to the outer side of the pedestal and biassing the first engaging ends to engage said helical groove of the stem; and means for releasing the first engaging end from the helical groove when the stem is moved downward.

Certainly, the dog members may further include a second engaging end opposite to the first engaging end, the pedestal having two openings in the wall thereof at diametrically opposite positions. The wall around each opening converges at the inner side of the wall to engage with the second engaging end so as to release temporarily the first engaging end from the helical groove. Moreover, the stem may have a flange radially projecting from the periphery thereof to push away the second engaging ends from the respective openings when the penetrating screw penetrates into the cork to an appropriate extent.

The present exemplary preferred embodiment will be described in detail with reference to the following drawings, in which:

DETAILED DESCRIPTION OF THE PREFERRED EMBODIMENT

Figure 1:
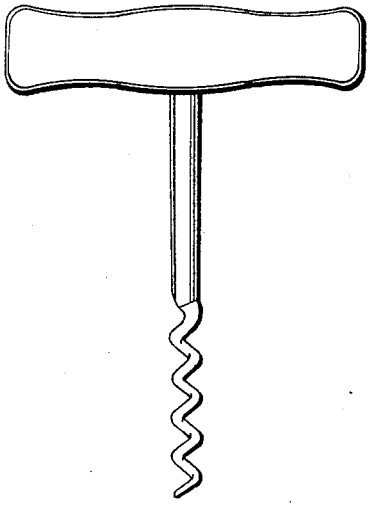
FIG. 1 PRIOR ART
FIG. 1 is a view of a conventional cork screw.
Figure 2:
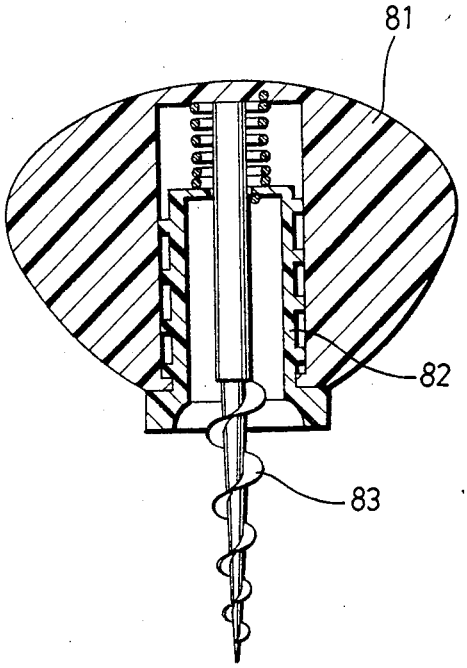
FIG. 2 PRIOR ART
FIG. 2 is a view of another conventional cork screw.
Figure 3:
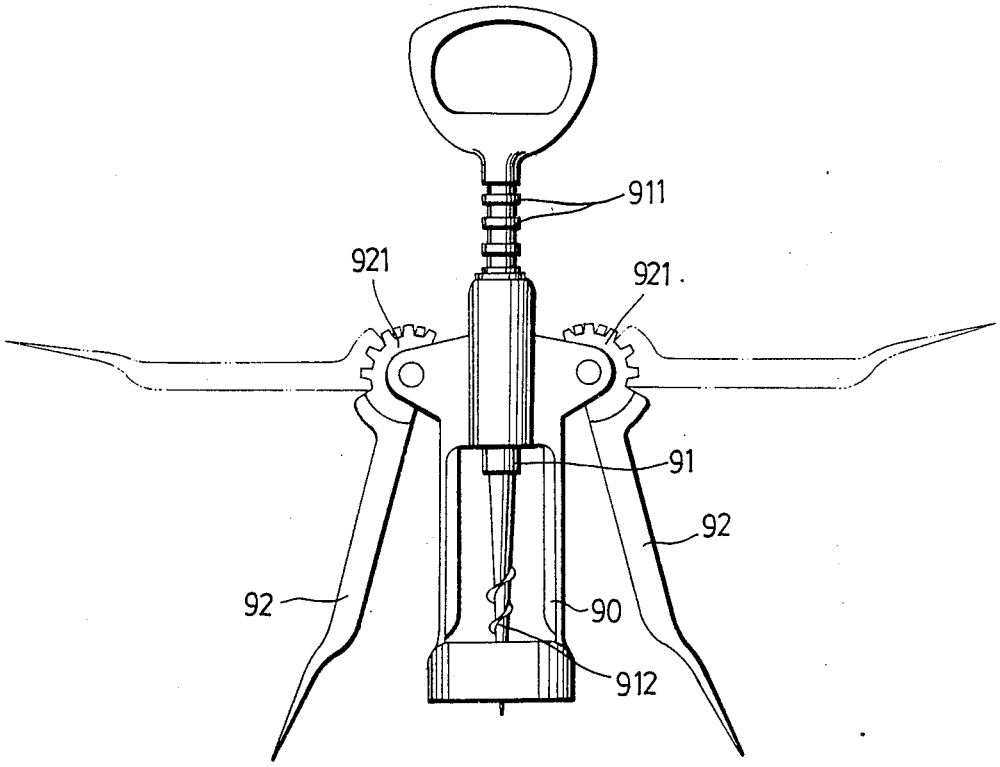
FIG. 3 PRIOR ART
FIG. 3 is a view of still another conventional cork screw.
Figure 4:
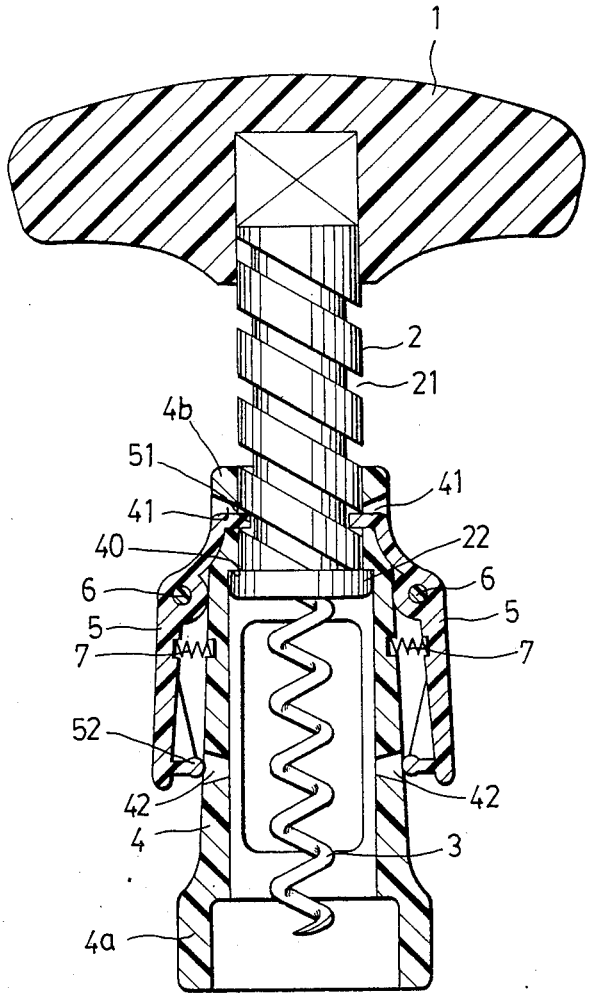
FIG. 4 is a sectional view of a cork screw embodying the present invention and FIG. 5 is a section view of a cork screw of FIG. 4 in an operating situation.

Referring to FIG. 4, an embodiment of a cork screw according to the present invention includes a rotary handle 1 incorporating a fixed stem 2 and a penetrating screw which is in the form of a helically extending rod with a pointed end. The stem 2 is provided with a helical groove 21 which extends throughout its length, and an annular flange 22 at the bottom end of the stem.

A hollow pedestal 4 is sleeved movably around the stem 2 and surrounds the penetrating screw 3. The inner side of the wall of a bottom portion **4*a* of the pedestal 4 is substantially shaped to conform to a spout of a bottle so that the pedestal 4 can be seated firmly on the bottle when the cork screw is used. The inner surface of the wall of an upper portion 4*b* of the pedestal 4 is in sliding contact with the periphery of the stem 2. Below the inner surface of the upper portion 4*b* is an inner shoulder 40 which can engage with the flange 22 of the stem so that the stem will not release from the pedestal 4**.

Provided in the wall of the pedestal 4 are two diametrically opposite openings 41 and two diametrically opposite openings 42. The wall around the openings 42 converges slightly toward the inner side of the wall of the pedestal. Two dog members 5 are fulcrumed by means of pivots 6 on the outer side of the wall of the pedestal 4. A spring 7 is affixed to the pedestal wall adjacent to each dog member 5 and engages with the dog member 5 to bias normally an upper engaging end 51 of the dog member to an engaging position with the helical groove of the stem 2 through the opening 41. A lower engaging end 52 is disposed at a bottom end of each dog member 5 to be engaged in the opening 42 of the pedestal 4 when the upper engaging end 51 is released from the opening 41. Each lower engaging end 52 is formed of a slightly resilient pin with a nodule end projecting from the dog member 5 preferably with an inclination at a substantially right angle. When the engaging ends 52 are pressed into the openings 42, the nodule end of the pins engages with the upper edge of the inner side of the openings 42, thereby being held releaseably in the opening 42.

Figure 5:
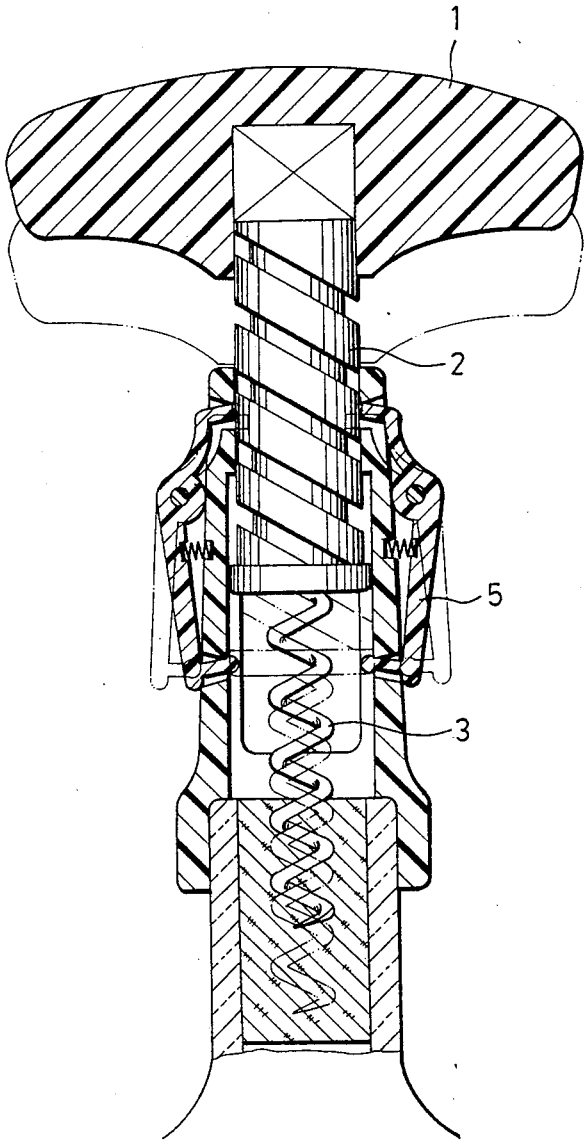

FIG. 5 shows how the cork screw is used to remove a cork from a bottle, wherein the pedestal 4 is seated on the spout of the bottle. Before the handle 1 is rotated, the bottom engaging ends of dog members 5 are pressed into the openings 42 of the pedestal so that dog members 5 are turned about the pivots 6 and the upper engaging ends 51 are released from the openings 41 and disengaged from the helical groove 21. When the handle 1 is rotated, the stem 2 moves slidingly downward and the penetrating screw 3 penetrates into the cork of the bottle. When the flange 22 of the stem approaches the openings 42, it pushes the engaging ends 52, thereby disengaging the engaging ends 52 from the openings 42, and letting the engaging ends 51 engage again with helical groove of the stem by the action of the springs 7. Upon rotating continuously the handle 1 in the same direction, the stem 2 moves upward, pulling the penetrating screw 3 and the cork upward from the bottle.

It can be appreciated that the present cork screw can be operated by simply rotating the handle without the need to operate any member other than the handle in order to pull out the cork from the bottle. Moreover, the cork screw provides a quick action pull of the cork since one revolution of the handle moves upward the cork to a distance substantially equal to one pitch distance of the helical groove 21 plus one pitch distance of the penetrating screw 3. In addition, the harmful penetrating screw 3 can be kept firmly in the pedestal 4 by engagement of the stem and the dog members so that it will not be exposed and harm anybody when not in use.

With the invention thus explained, it is apparent that various modifications and variations can be made without departing from the scope of the invention. It is therefore intended that the invention be limited as indicated in the appended claims.

What is claimed is:

1. A cork screw comprising:

a rotary handle;

a stem connected to said handle and having a helical groove extending on the periphery of said stem;

a penetrating screw fixed to the bottom of said stem;

a hollow pedestal provided around said stem and said penetrating screw, the wall of said pedestal having an upper portion sleeved slideably on said stem, first openings in said upper portion, a bottom portion adapted to be seated against a spout of a bottle, and an engaging means provided in a portion between said upper portion and said bottom portion;

two dog members funcrumed at two opposite outer sides of said pedestal and each having a first engaging end capable of extending through one of said first openings to engage with said helical groove, and a second engaging end opposite to said first engaging end capable of engaging releaseably said engaging means so as to temporarily maintain said first engaging end in a released position from said helical groove; and springs members attached to the outer side of said pedestal and normally biassing said first engaging ends to engage with said helical groove of said stem.

2. A cork screw as claimed in claim 1, wherein said engaging means of said pedestal includes two opposite second openings in the wall of said pedestal, the wall around each of said second openings converging toward the inner side of the wall of said pedestal, and each of said second engaging end is formed of a slightly resilient pin projecting from said dog member and having a nodule end to engage releaseably with said opening.

3. A cork screw as claimed in claim 3, wherein said stem further includes a flange extending radially outward from the periphery of said stem so as to push away said nodule ends of said second engaging ends from said second openings.

* * * * *